US006789630B2

(12) United States Patent
Quirijnen et al.

(10) Patent No.: US 6,789,630 B2
(45) Date of Patent: Sep. 14, 2004

(54) ELECTRIC HAND TOOL

(75) Inventors: Antonius Jacobus Johannus Quirijnen, Molenshot (NL); Jan Peter Houben, Poppel (BE); Antony Moolenaar, Dorst (NL)

(73) Assignee: Skil Europe B.V., Breda (NL)

( * ) Notice: Subject to any disclaimer, the term of this patent is extended or adjusted under 35 U.S.C. 154(b) by 0 days.

(21) Appl. No.: 09/798,558

(22) Filed: Mar. 2, 2001

(65) Prior Publication Data

US 2001/0052419 A1 Dec. 20, 2001

(30) Foreign Application Priority Data

Mar. 3, 2000 (NL) ..... 1014558

(51) Int. Cl.[7] ..... E02D 7/02
(52) U.S. Cl. ..... 173/48; 173/216; 173/114
(58) Field of Search ..... 173/213, 216, 173/217, 48, 164, 47, 114, 109; 74/527

(56) References Cited

U.S. PATENT DOCUMENTS 3,774,699 A * 11/1973 Schmuck ..... 173/109
3,834,468 A * 9/1974 Hettich et al. ..... 173/109
3,835,715 A * 9/1974 Howell ..... 173/109
3,837,409 A * 9/1974 Consoli et al. ..... 173/109
3,845,826 A * 11/1974 Beisch ..... 173/109
4,236,588 A * 12/1980 Moldan et al. ..... 173/201
4,400,995 A * 8/1983 Palm ..... 173/164
4,763,733 A * 8/1988 Neumaier ..... 173/109
4,804,048 A * 2/1989 Porth, Jr. ..... 173/47
5,022,188 A * 6/1991 Borst ..... 451/342
5,070,266 A * 12/1991 Janczak et al. ..... 310/77
5,430,944 A 7/1995 Shilling
6,139,228 A * 10/2000 Longo ..... 279/150
6,213,695 B1 * 4/2001 Breitenmoser ..... 409/231
6,223,833 B1 * 5/2001 Thurler et al. ..... 173/48

FOREIGN PATENT DOCUMENTS

DE 36 03 461 A1 8/1987
GB 2304067 A * 3/1997 ..... B23B/45/16

* cited by examiner

*Primary Examiner*—Scott A. Smith
*Assistant Examiner*—Louis Tran
(74) *Attorney, Agent, or Firm*—Gardner Carton & Douglas, LLP

(57) ABSTRACT

The present invention relates to an electric hand tool, in particular a drill or a screwdriver, comprising a housing, an electric motor accommodated therein and having a motor shaft, a tool shaft which is mounted in the housing and which is driven by the motor shaft via a transmission, and a hand-operated locking mechanism for blocking the rotating movement of the tool shaft, wherein this locking mechanism acts on the motor shaft, so that it is possible to suffice with a lesser locking force in order to block the tool shaft with the same locking effect.

1 Claim, 4 Drawing Sheets

ELECTRIC HAND TOOL

Figure 1:
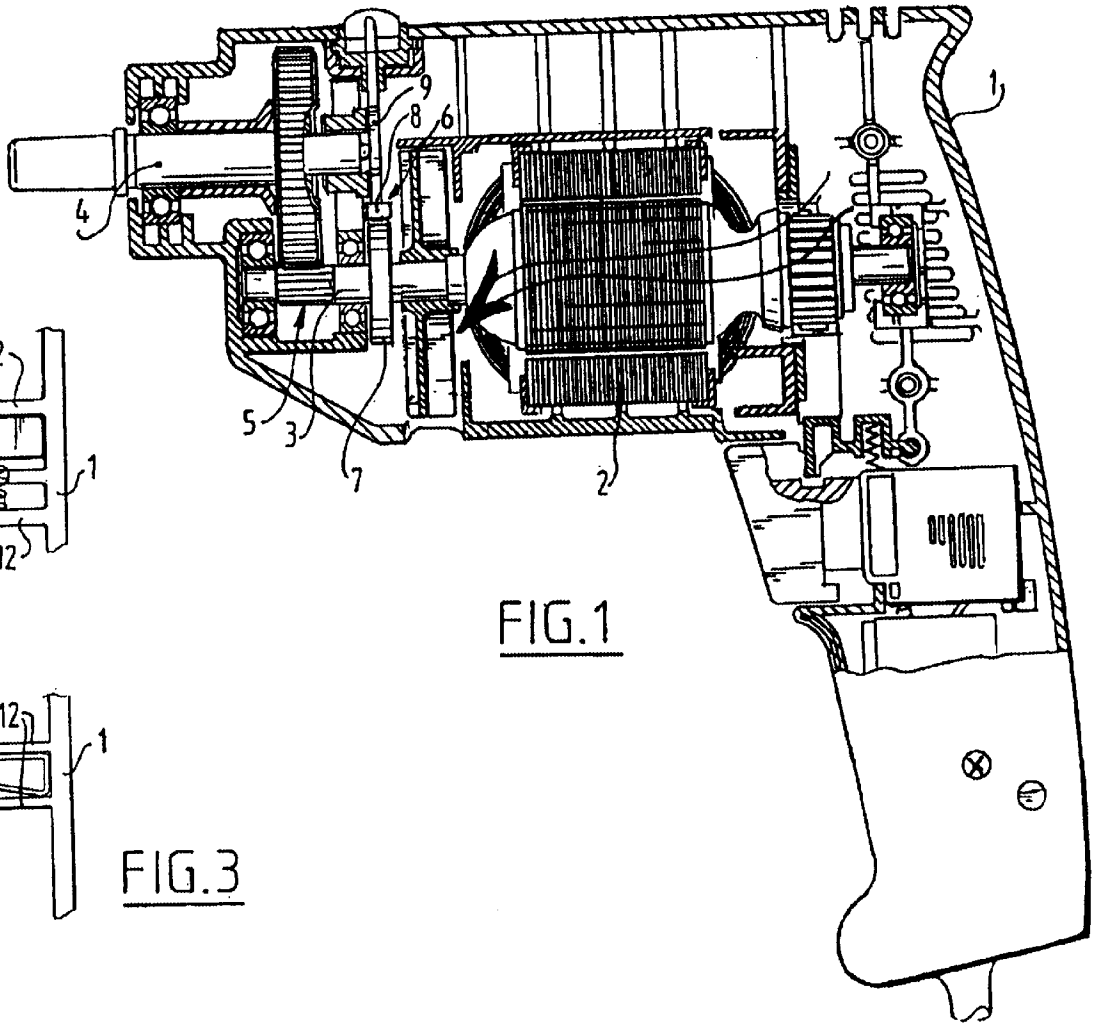

The present invention relates to an electric hand tool, in particular a drill or a screwdriver, comprising a housing, an electric motor accommodated therein and having a motor shaft, a tool shaft which is mounted in the housing and which is driven by the motor shaft via a transmission, and a hand-operated locking mechanism for blocking the rotating movement of the tool shaft.

Such an electric hand tool is known from the British patent application GB 2 304 067 A. In this known electric hand tool the transmission is formed by a drive pinion which is arranged on the motor shaft and which co-acts with a toothed wheel connected non-rotatably to the tool shaft. Provided in the toothed wheel are axial bores in which a locking pin displaceable in axial direction can be placed to block the rotating movement of the tool shaft. The locking element is displaced in axial direction by a rotary knob to be operated from outside the housing. In order to enable exchange of a tool the locking pin is displaced axially relative to the tool shaft by means of the rotary knob until it drops into one of the axial bores of the toothed wheel and thereby blocks the tool shaft.

The object of the present invention is to provide an electric hand tool which is provided with an improved locking mechanism for blocking the rotation movement of the tool shaft. Another objective of the present invention is to provide an electric hand tool provided with a locking mechanism which takes a structurally simple form and necessitates only minimal modification of the existing construction of the hand tool.

To this end the electric hand tool according to the present invention is characterized in that the locking mechanism acts on the motor shaft. The motor shaft lies at a greater distance from the tool shaft than the point at which the locking mechanism of the known hand tool engages. Owing to the greater distance (arm) it is possible to suffice with a lesser locking force in order to block the tool shaft with the same locking effect (moment).

The locking mechanism preferably comprises a first locking element connected non-rotatably to the motor shaft and a second locking element displaceable relative to the housing in the direction of the first locking element. The point of contact of the locking mechanism hereby comes to lie at a distance from the motor shaft and the arm is made even longer. An even smaller locking force is required to obtain the same locking moment. The locking mechanism can therefore be of lighter construction, which results in an economic advantage.

An activating element to be operated from outside the housing is provided for displacement of the second locking element in the direction of the first locking element.

The activating element is preferably received slidably in the housing so that the activating element is guided by the housing.

In order to unblock the rotation movement of the tool shaft after exchanging the tool, the second locking element is biased in a direction away from the first locking element. When the activating element is no longer being operated, the second locking element will return under the influence of the bias to its starting position and disengage from the first locking element.

In an advantageous embodiment according to the invention a resilient member is arranged between the activating element and the second locking element. The activating element to be operated by the user is hereby not in direct contact with the second locking element, so that when the locking mechanism is operated the user is less affected by the reaction force generated by engagement between the first and second locking element. The resilient member partially takes over the reaction force and then transmits it to the housing.

If the hand tool further comprises a hammer mechanism for periodic displacement of the tool shaft in axial direction, which mechanism is actuated via an activating element accessible from outside the housing, the hand tool according to the present invention is further characterized in that the activating element for actuating the hammer mechanism is also used to actuate the locking mechanism. In this way use is advantageously made of existing structural parts already present in the hand tool.

The activating element is then preferably displaceable via a first control member in the direction of the motor shaft and via a second control member in tangential direction of the tool shaft. The second control member has two positions, a first position for drilling and a second position for hammer drilling. In both the first and second position of the second control member the locking mechanism according to the present invention can be activated by operating the first control member.

Figure 2:
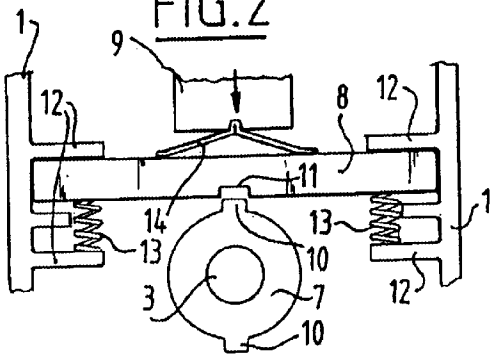
Figure 3:
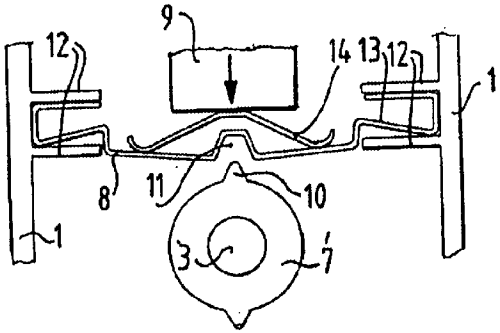
Figure 4:
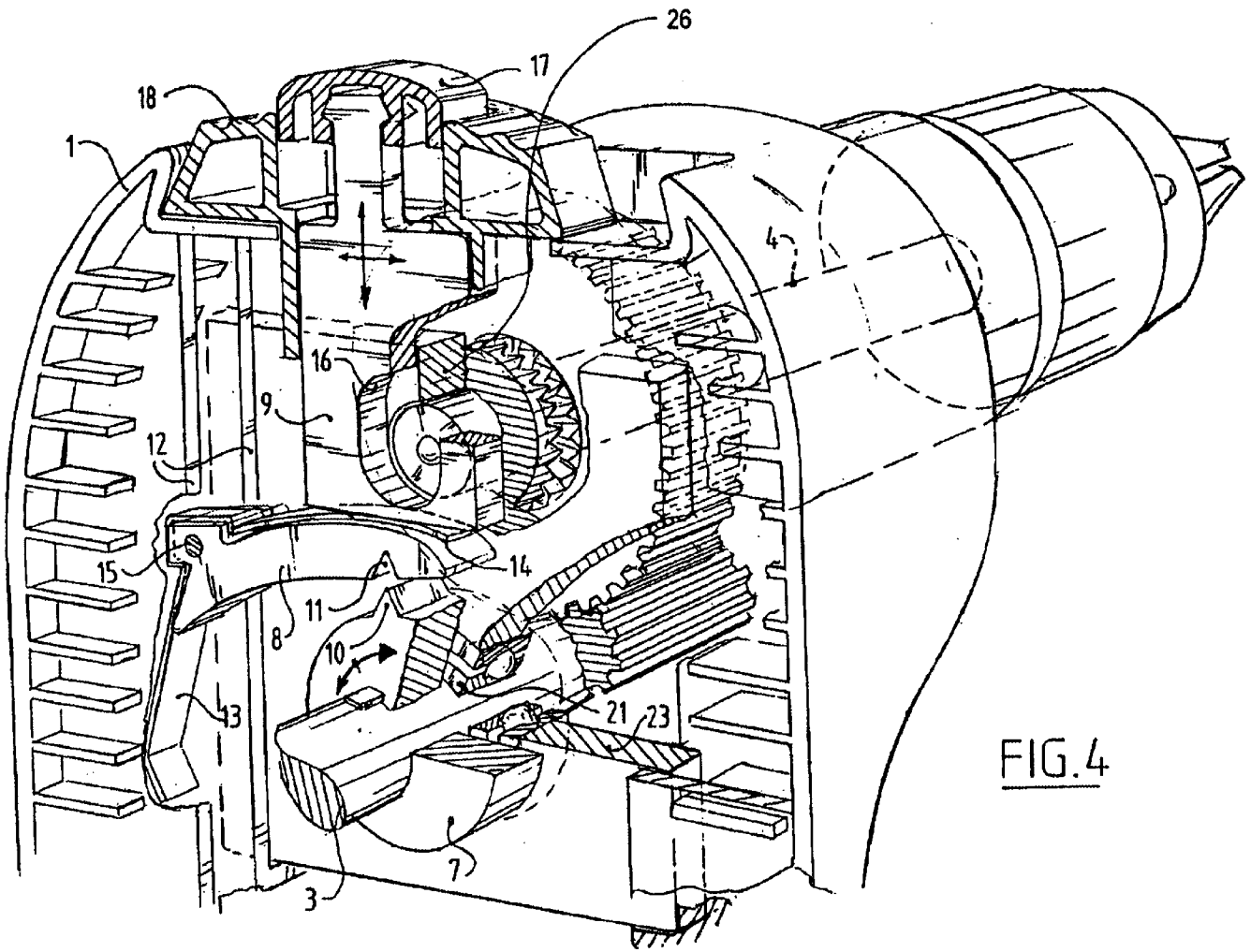
Figure 5:
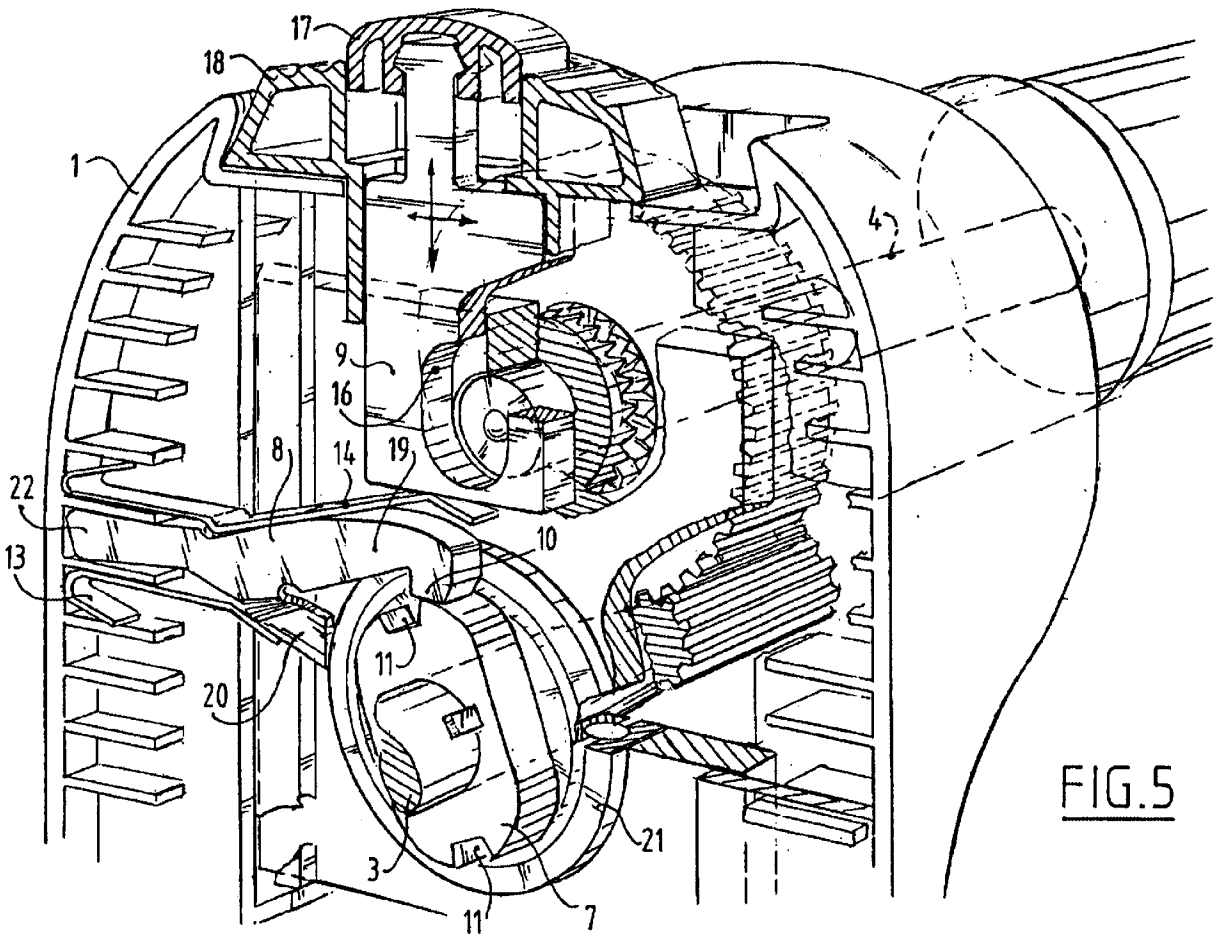
Figure 6:
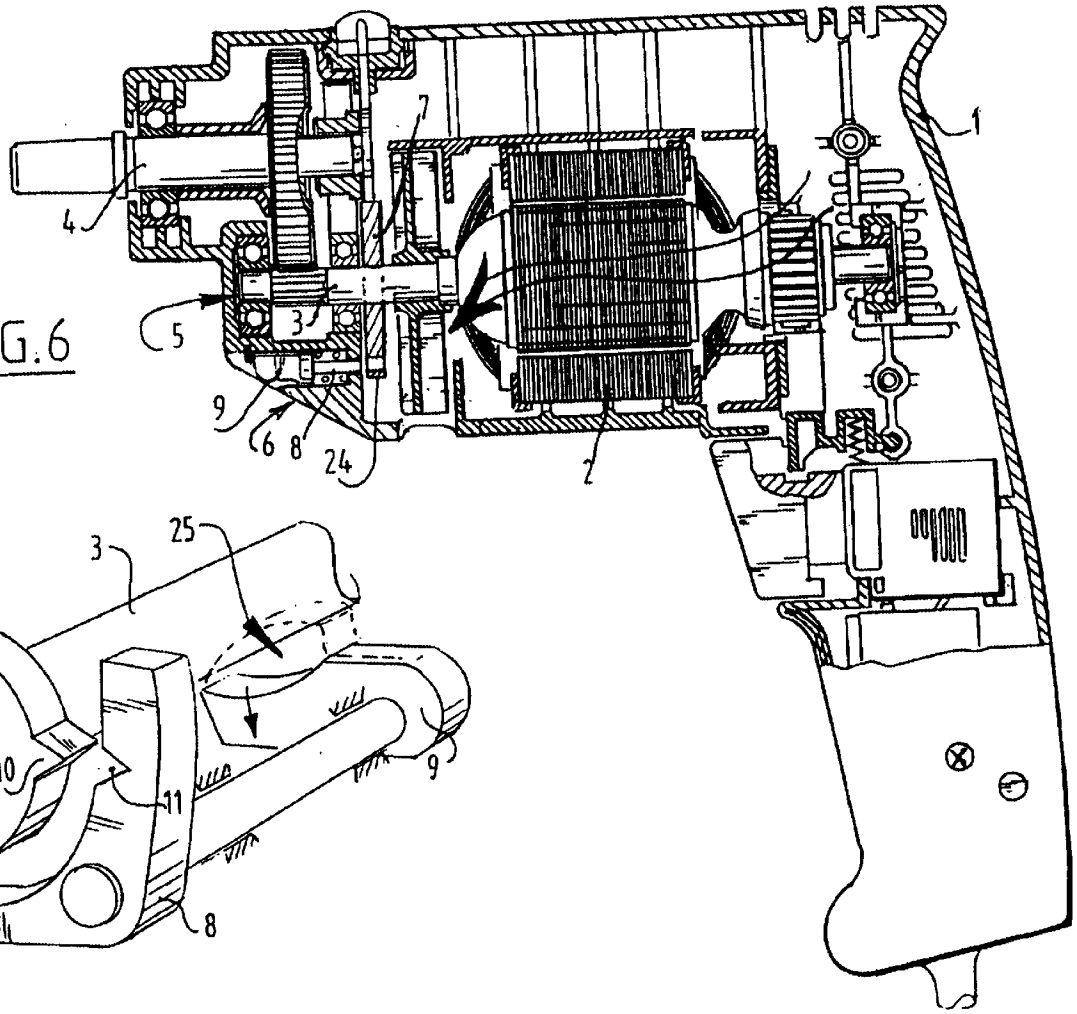
Figure 7:
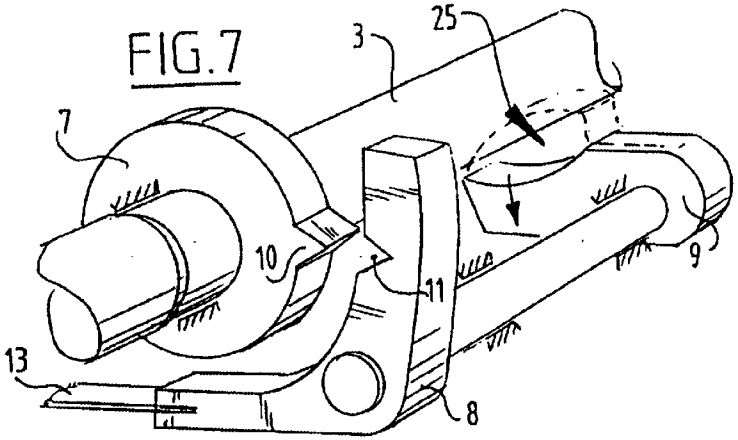

The present invention will be further elucidated with reference to the annexed drawings. In the drawings:

FIG. 1 shows a section of an electric hand tool provided with a hand-operated locking mechanism according to the present invention, FIG. 2 shows a schematic view of a first embodiment of a locking mechanism according to the present invention, FIG. 3 shows a schematic view of a second embodiment of a locking mechanism, FIG. 4 is a perspective, partly cross-sectional view of a hammer drill provided with a locking mechanism in a third embodiment, FIG. 5 is a perspective, partly cross-sectional view of the hammer drill shown in FIG. 4 which is provided with a locking mechanism in a fourth embodiment, FIG. 6 shows a section of an electric hand tool provided with a hand-operated locking mechanism in a fifth embodiment, and FIG. 7 shows a schematic perspective view of a sixth embodiment of a locking mechanism for an electric hand tool.

Corresponding components of the electric hand tool are designated in the drawings with corresponding reference numerals.

FIG. 1 shows the electric hand tool in section. The hand tool comprises a housing 1, an electric motor 2 accommodated therein with a motor shaft 3, and a tool shaft 4 mounted in housing 1 which is driven by motor shaft 3 via a transmission 5. In addition, the electric hand tool is provided with a hand-operated locking mechanism 6 for blocking the rotation movement of tool shaft 4. According to the present invention the locking mechanism 6 acts on motor shaft 3. Locking mechanism 6 comprises a first locking element 7 connected non-rotatably to motor shaft 3 and a second locking element 8 displaceable relative to housing 1 in the direction of the first locking element 7. An activating element 9 to be operated from outside housing 1 is further provided for displacing the second locking element 8.

Shown schematically in FIG. 2 is a first embodiment of locking mechanism 6 for blocking the rotation movement of tool shaft 4. Activating element 9 can be operated in the direction of motor shaft 3 to place the first and second locking elements into mutual contact, and therefore to block the rotation movement of the tool shaft. The second locking element 8 is arranged guidably between the walls of housing 1. The second locking element 8 can therefore be displaced by activating element 9 in the direction of first locking element 7. The first locking element 7 is connected non-rotatably to motor shaft 3. Two cams 10 are provided on the periphery of first locking element 7, while a recess 11 co-acting with cams 10 is arranged on second locking element 8. It is of course possible to provide second locking element 8 with a cam and first locking element 7 with one or more recesses co-acting therewith. Second locking element 8 is further biased in a direction away from first locking element 7 by means of pressure springs 13 arranged between ribs 12 of housing 1 and the second locking element 8. Finally, a resilient element 14 is arranged between activating element 9 and second locking element 8.

After operation of the locking mechanism the activating element 9 is displaced in the direction of motor shaft 3. Via resilient member 14 the displacement of activating element 9 is transferred to second locking element 8. This latter will be displaced in the direction of first locking element 7 counter to the spring force of pressure springs 13, so that recess 11 of second locking element 8 comes into contact with one of the cams 10 of first locking element 7. Through engagement of second locking element 8 with first locking element 7 the motor shaft 3, which is connected non-rotatably to locking element 7, will be blocked. The rotating movement of tool shaft 4 will therefore also be blocked by blocking of motor shaft 3. The resilient member 14 will partially absorb the reaction force resulting from recess 11 and cam 10 coming into contact, so that this force will not be transmitted wholly to the operator of the locking mechanism. After the tool has been exchanged, the operation can be stopped, whereafter pressure springs 13 ensure that second locking element 8 is set back into its starting position and blocking of motor shaft 3 is ended.

FIG. 3 shows schematically a second embodiment of the locking mechanism according to the present invention. In this embodiment the second locking element 8 is formed by a resilient element enclosed between ribs 12 of housing 1. Owing to the particular form of this resilient element the second locking element 8 will return of its own accord to its starting position when operation of the locking mechanism is ended.

FIG. 4 shows a perspective view of an electric hand tool provided with a locking mechanism in a third embodiment of the invention. In this embodiment the resilient member 14 arranged over second locking element 8 also provides a biasing of second locking element 8. This latter is connected rotatably to housing 1 of the hand tool by means of a bearing pin 15 mounted on a bearing plate 23 arranged in housing 1. The second locking element 8 is guided laterally between ribs 12 of housing 1.

The hand tool shown in FIG. 4 comprises a hammer mechanism for periodic displacement of tool shaft 4 in axial direction. This hammer mechanism (26) is a well-known mechanism and is therefore not elucidated further. The hammer mechanism is activated via an activating element 9 accessible from outside the housing. This activating element 9 also forms the activating element for activating the locking mechanism. Activating element 9 is provided with an opening 16 for passage of tool shaft 4 when the hammer mechanism is switched on. Activating element 9 is displaceable in the direction of motor shaft 3 via a first control member 17 and in tangential direction of tool shaft 4 via a second control member 18. The first control member 17 is a push-button for displacing activating element 9 in the direction of motor shaft 3. The second control member 18 is a slide switch for displacing activating element 9 in tangential direction of tool shaft 4. As shown in FIG. 4, the hammer mechanism is activated when slide switch 18 is in the left-hand position and opening 16 lies in line with tool shaft 4. The hammer mechanism is deactivated when slide switch 18 is moved from the left-hand position to the right-hand position. In both positions of slide switch 18 the locking mechanism can be operated by depressing push-button 17. It is thus possible during both drilling and hammer drilling to block the tool shaft 4 in order to exchange the tool.

FIG. 5 shows a perspective view of a fourth embodiment of the locking mechanism. The operation of the hammer mechanism and the locking mechanism is the same as that of the embodiment shown in FIG. 4. In this fourth embodiment the first locking element 7 is formed by a disc of oval shape connected non-rotatably to motor shaft 3. This oval shape provides feedback to the operator when he activates the locking mechanism. When push-button 17 is depressed the activating element 9 will displace in the direction of motor shaft 3 and bring cam 10 of the second locking element into contact with the oval outer surface of first locking element 7. As it approaches the recess 11 of first locking element 7 the second locking element 8 will be displaced slightly upward due to the increasing diameter of first locking element 7. This is transmitted to the operator via activating element 9. In this manner the operator knows that second locking element 8 can engage at that moment with first locking element 7. The danger of forcing and wear of the locking mechanism is hereby prevented.

The second locking element 8 takes the form of a gripper, of which a first gripping arm 19 is provided with the cam 10 and a second gripping arm 20 rests against the outer surface of the bearing 21 for motor shaft 3 arranged fixedly in the housing. The base 22 of gripper 8 lies between the ribs 12 of housing 1. This particular form of second locking element 8 ensures that it clamps itself fixedly in the housing during engagement with first locking element 7. Since the locking mechanism has to fulfil its function during both loosening and tightening of the drill chuck, it must be able to absorb forces in both rotation directions of tool shaft 4. The embodiment of the second locking element according to FIG. 5 is particularly suitable for this purpose. It is not therefore necessary to connect second locking element 8 rotatably to the housing.

This fourth embodiment is also particularly advantageous since the construction of the hand tool requires only a few modifications. During assembly it is only necessary to place the second locking element 8 with the resilient elements 13, 14 between ribs 12 of housing 1, connect locking disc 7 non-rotatably to motor shaft 3 and provide the already available activating element 9 with an oval-shaped opening 16 so as to enable sliding of activating element 9 in the hammer drill position. A final modification is the arranging in the already present operating slide part 18 of an operating part 17 displaceable in the direction of motor shaft 3.

A fifth embodiment of a locking mechanism 6 is shown in the section of FIG. 6. The locking element 7 connected non-rotatably to motor shaft 3 is herein provided with at least one axial hole 24. The second locking element 8 is formed by a pin displaceable in axial direction which can be placed in the axial hole of first locking element 7 by depressing activating element 9. The second locking element 8 is biased in a direction away from first locking element 7 by a pressure spring 13 arranged between control member 9 and housing 1. In this fifth embodiment both operation and locking take place in axial direction, while the operation and locking shown in FIGS. 1–5 take place in radial direction. It is noted that, instead of an axial hole, the first locking element can be provided on its outer edge with recesses with which the second locking element 8 can make contact.

Finally, FIG. 7 shows schematically a sixth embodiment of a locking mechanism 9, wherein the operation takes place by rotation rather than by the above described manners of operation by translation. The activating element 9 located in the housing (not drawn) can be operated from outside the housing via a passage 25 arranged therein. Locking elements 7 and 8 are brought into mutual contact by rotating activating element 9. A leaf spring 13 ensures that when activating element 9 is released the second locking element 8 returns to its starting position.

Use is made in the embodiments shown in FIGS. 1–5 and 7 of a cam 10 on the one hand and a recess 11 on the other to bring about locking. The shapes of cam 10 and recess 11 are preferably complementary. The angles enclosed by the walls of cam 10 and recess 11 can herein be either obtuse or acute. In the case of an obtuse angle it is relatively simple to effect a locking, but a comparatively large pressure force is needed to maintain the locking. Effecting the locking is less simple in the case of an acute angle; the motor shaft will first have to be slowed down sufficiently to enable engagement of the cam and the recess at the correct moment. The risk of damage to the locking mechanism is however reduced here. In addition, a smaller pressure force is required to maintain the locking.

What is claimed is:

1. An electric hand tool comprising:

(a) a housing;

(b) an electric motor accommodated therein and having a motor shaft (c) a tool shaft which is mounted in the housing and which is driven by the motor shaft via a transmission, said transmission comprises a pinion non-rotatably connected to the motor shaft; and (d) a hand-operated locking mechanism for blocking the rotating movement of the tool shaft, wherein the locking mechanism acts directly on the motor shaft and comprises a first locking element connected non-rotatably to the motor shaft and a second locking element displaceable relative to the housing in a direction towards the first locking mechanism, and wherein the first locking element has a larger radius than the pinion, (e) a hammer mechanism for periodic displacement of the tool shaft in axial direction, which mechanism is actuated via an activating element accessible from outside the housing, characterized in that the activating element for actuating the hammer mechanism is also used to actuate the locking mechanism wherein the activating element is displaceable via a first control member in a direction towards the motor shaft and via a second control member in tangential direction of the tool shaft.

* * * * *